US011310595B2

(12) United States Patent
Dai et al.

(10) Patent No.: US 11,310,595 B2
(45) Date of Patent: Apr. 19, 2022

(54) AUDIO ADAPTER WITH FREQUENCY MODULATION RADIO FUNCTION AND OPERATION METHOD THEREOF

(71) Applicant: REALTEK SEMICONDUCTOR CORPORATION, Hsinchu (TW)

(72) Inventors: Jyun-Min Dai, Hsinchu (TW); Chun-Hao Peng, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 0 days.

(21) Appl. No.: 17/089,760

(22) Filed: Nov. 5, 2020

(65) Prior Publication Data

US 2021/0144471 A1 May 13, 2021

(30) Foreign Application Priority Data

Nov. 7, 2019 (TW) ..... 108140471

(51) Int. Cl.
*H04R 3/00* (2006.01)
*H01R 13/66* (2006.01)
*H04H 40/45* (2008.01)

(52) U.S. Cl.
CPC ..... *H04R 3/00* (2013.01); *H01R 13/6675* (2013.01); *H04H 40/45* (2013.01)

(58) Field of Classification Search
CPC .. H04R 3/00; H04R 1/1091; H04R 2227/005; H01R 13/6675; H01R 43/205; H01R 2201/02; H01R 2201/24; H04H 40/45
(Continued)

(56) References Cited

U.S. PATENT DOCUMENTS 7,400,859 B2 * 7/2008 Dayan ..... H04B 1/034 455/41.2
9,560,431 B1 * 1/2017 Lilly ..... A47G 23/0216
(Continued)

FOREIGN PATENT DOCUMENTS

TW 201127095 A 8/2011
TW M468798 U 12/2013

OTHER PUBLICATIONS

OA letter of the counterpart TW application (appl. No. 108140471) mailed on Sep. 30, 2020. Summary of the OA letter: (1). Claim 1 is rejected under Taiwan Patent Law Article 22(2) as being unpatentable over reference 1 (US 2011/0040901A1) and reference 2 (US 2011/0045775A1). (2). Claims 3-4 are rejected under Taiwan Patent Law Article 22(2) as being unpatentable over reference 1, reference 2 and reference 3 (Tw M468798). (3). Claim 5 is rejected under Taiwan Patent Law Article 22(2) as being unpatentable over reference 1, reference 2, reference 3 and reference 4 (TW 201127095A).

*Primary Examiner* — Xu Mei
(74) *Attorney, Agent, or Firm* — WPAT, PC

(57) ABSTRACT

An audio adapter with a frequency modulation (FM) radio function is provided. The audio adapter includes an audio jack, an FM processing circuit, an audio codec, a digital interface, a memory and a processing unit. The FM processing circuit is configured to receive an FM signal through the audio jack and process the FM signal to generate an FM audio. The audio codec is configured to receive the FM audio and output an analog output audio containing the FM audio through the audio jack. The digital interface transmits power. The memory is configured to store multiple codes or program instructions. The processing unit is configured to execute the codes or program instructions to control the FM processing circuit to search for FM channel(s).

12 Claims, 5 Drawing Sheets

(58) Field of Classification Search
USPC ..... 381/91, 92, 122, 77, 124; 439/577, 668, 439/669
See application file for complete search history.

(56) References Cited

U.S. PATENT DOCUMENTS

| | | | | |
|---|---|---|---|---|
| 9,864,569 | B2 * | 1/2018 | Pelland | H04R 3/00 |
| 9,955,258 | B2 * | 4/2018 | Chan | H04R 3/04 |
| 10,969,853 | B2 * | 4/2021 | Chang | G06F 1/3215 |
| 11,144,205 | B2 * | 10/2021 | Peng | G05B 19/42 |
| 2010/0161857 | A1 * | 6/2010 | Ding | G06F 3/16 710/69 |
| 2011/0040901 | A1 | 2/2011 | Khan et al. | |
| 2011/0045775 | A1 | 2/2011 | Jeong et al. | |
| 2013/0170526 | A1 * | 7/2013 | Lee | H04B 1/034 375/219 |

* cited by examiner

AUDIO ADAPTER WITH FREQUENCY MODULATION RADIO FUNCTION AND OPERATION METHOD THEREOF

BACKGROUND

1. Field of the Invention

The present disclosure generally relates to audio adapters (also known as audio dongles), and, more particularly, to audio adapters with frequency modulation (FM) radio function.

2. Description of Related Art

Electronic devices with built-in frequency modulation (FM) radio function usually use the wired headphone or earphone connected to the 3.5 mm audio jack of the electronic device as an antenna to receive FM signals. However, since more and more electronic devices replace the traditional audio jack with a digital interface (such as Universal Serial Bus (USB), Lightning and Thunderbolt) for the transmission of audio data, modern electronic devices which do not have the traditional audio jack can only receive the FM broadcast signals through the digital interface. Unfortunately, using a digital interface to receive the FM broadcast signals has the following disadvantages: (1) the digital interface may interfere with the reception of the FM broadcast signals through the antenna due to its high data transmission speed and large current (because the digital interface usually serves as a charging port as well); and (2) the current digital interfaces, which do not define any antenna pin in the specification, must be customized to provide a pin for the reception of the FM broadcast signals, but customization may not only have impacts on the predefined functions of the digital interface but cause compatibility issues.

SUMMARY

In view of the issues of the prior art, an object of the present disclosure is to provide an audio adapter with FM radio function and its operation method, so as to make an improvement to the prior art.

An audio adapter with frequency modulation (FM) radio function is provided. The audio adapter includes an audio jack, an FM processing circuit, an audio codec, a digital interface, a memory and a processing unit. The FM processing circuit is coupled to the audio jack and configured to receive an FM signal through the audio jack and to process the FM signal to generate an FM audio. The audio codec is coupled to the FM processing circuit and the audio jack and configured to receive the FM audio and to output through the audio jack an analog output audio that contains the FM audio. The digital interface transmits power. The memory is configured to store multiple program codes or program instructions. The processing unit is coupled to the FM processing circuit, the audio codec, the digital interface and the memory and configured to execute the program codes or the program instructions to control the FM processing circuit to search for an FM channel.

The audio adapter with FM radio function provided in this disclosure uses a regular (not customized) digital interface and is therefore highly compatible with all kinds of hosts and power supply devices equipped with the same digital interface, making listening to FM radio a lot easier since compatibility is not an issue. In addition, the interference of the digital interface with the FM broadcast signals, which is a disadvantage of the conventional solution, does not occur to the audio adapter with FM radio function provided in this disclosure because the unmodulated FM broadcast signals are not received via the digital interface.

These and other objectives of the present disclosure no doubt become obvious to those of ordinary skill in the art after reading the following detailed description of the preferred embodiments with reference to the various figures and drawings.

DETAILED DESCRIPTION OF THE EMBODIMENTS

The following description is written by referring to terms of this technical field. If any term is defined in this specification, such term should be interpreted accordingly. In addition, the connection between objects or events in the below-described embodiments can be direct or indirect provided that these embodiments are practicable under such connection. Said "indirect" means that an intermediate object or a physical space exists between the objects, or an intermediate event or a time interval exists between the events.

The disclosure herein includes an audio adapter with frequency modulation (FM) radio function and the operation method thereof. On account of that some or all elements of the audio adapter with FM radio function could be known, the detail of such elements is omitted provided that such detail has little to do with the features of this disclosure, and that this omission nowhere dissatisfies the specification and enablement requirements. Some or all of the processes of the operation method of the audio adapter with FM radio function may be implemented by software and/or firmware, and can be performed by the audio adapter with FM radio function or its equivalent. A person having ordinary skill in the art can choose components or steps equivalent to those described in this specification to carry out the present disclosure, which means that the scope of this disclosure is not limited to the embodiments in the specification.

In this document, the term "circuitry" may indicate a system formed with one or more circuits. The term "circuit" may indicate an object, which is formed with one or more transistors and/or one or more active/passive elements based on a specific arrangement, for processing signals. As used herein, the term "and/or" includes any combination of one or more of the listed items.

Although the terms "first," "second," etc., may be used herein to describe various elements, these elements should not be limited by these terms. Rather, these terms are only used to distinguish one element from another. For example, a first element could be termed a second element, and, similarly, a second element could be termed a first element, without departing from the scope of the embodiments.

Figure 1:
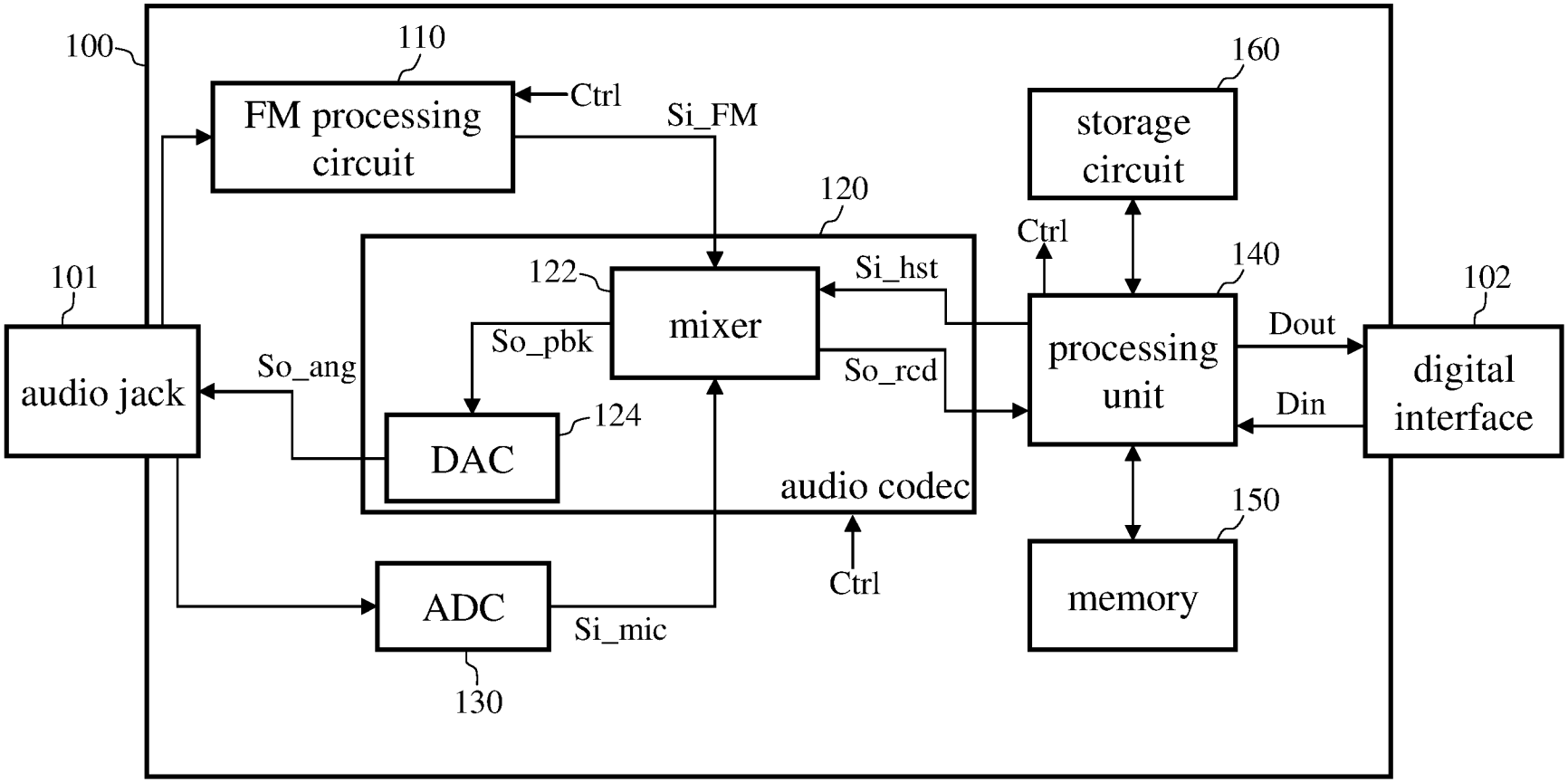
FIG. 1 illustrates a functional block diagram of an audio adapter with FM radio function according to this disclosure.

FIG. 1 is a functional block diagram of an audio adapter with FM radio function according to this disclosure. The audio adapter 100 includes an audio jack 101, a digital interface 102, an FM processing circuit 110, an audio codec 120, an analog-to-digital converter (ADC) 130, a processing unit 140, a memory 150 and a storage circuit 160. An audio device can be inserted into the audio jack 101. The audio device includes, but is not limited to, a headphone (or earphone) device and a headset device. The digital interface 102 is used to connect with a host (such as a computer, handheld device, mobile device, etc.) or a power supply device (such as a charger, portable power bank, etc.). In other words, power and data can be transmitted through the digital interface 102. The digital interface 102 includes, but is not limited to, USB, Lightning, Thunderbolt and other digital interfaces. The memory 150 may be a volatile memory, such as a static random access memory (SRAM) or a dynamic random access memory (DRAM). The storage circuit 160 may be a non-volatile memory, such as a flash memory. The memory 150 and/or the storage circuit 160 store multiple program instructions or program codes. The processing unit 140 may be a circuit or an electronic component with program execution capability, such as a central processing unit (CPU), a microprocessor or a microprocessing unit. The processing unit 140 executes the program instructions or program codes stored in the memory 150 and/or the storage circuit 160 to perform some functions of the audio adapter 100.

The FM processing circuit 110, which is coupled to the audio jack 101, receives the FM signal through the audio jack 101 and demodulates the FM signal to generate the FM audio Si_FM. In some embodiments, the FM processing circuit 110 has a built-in ADC (not shown), and the FM audio Si_FM is a digital signal.

The processing unit 140 receives the digital input signal Din from the host (not shown) through the digital interface 102 and parses the digital input signal Din to obtain an audio signal (hereinafter referred to as the host audio Si_hst) and/or a control signal Ctrl. For example, when the digital interface 102 is USB, the digital input signal Din includes one or more USB packets, and the processing unit 140 parses the USB packets, based on the USB protocol (e.g., the "Universal Serial Bus Device Class Definition for Audio Devices Specification") to obtain the host audio Si_hst. In some embodiments, the control signal Ctrl is generated by the processing unit 140 instead of the host.

When the device inserted into the audio jack 101 possesses the function of a microphone, the ADC 130 converts the analog microphone audio into the digital microphone audio Si_mic and sends the microphone audio Si_mic to the mixer 122 of the audio codec 120.

The mixer 122 receives the FM audio Si_FM, host audio Si_hst, and/or microphone audio Si_mic. Depending on the control signal Ctrl, the mixer 122 mixes these audios or not. The mixer 122 generates the digital playback audio So_pbk in response to the control signal Ctrl. The mixer 122 also generates the digital recorded audio So_rcd in response to the control signal Ctrl and transmits the recorded audio So_rcd to the processing unit 140. The digital-to-analog converter (DAC) 124 of the audio codec 120 is used to convert the playback audio So_pbk to the analog output audio So_ang, and the analog output audio So_ang is transmitted through the audio jack 101 to the audio device coupled to the audio jack 101. The processing unit 140 packages the recorded audio So_rcd according to the transmission protocol of the digital interface 102 to generate the digital output signal Dout, and the digital output signal Dout is transmitted to the host through the digital interface 102.

Figure 2:
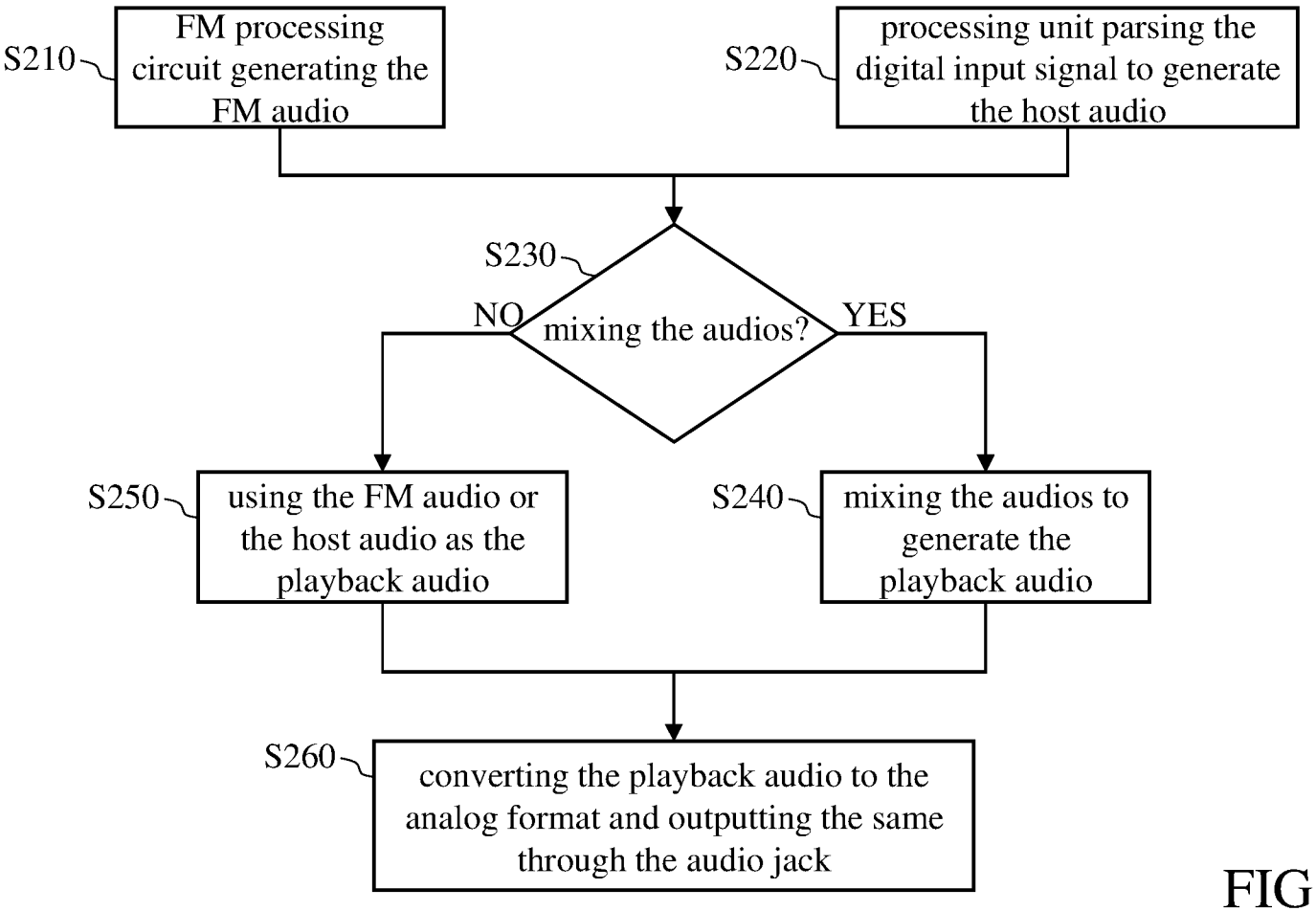
FIG. 2 illustrates a flowchart of the operation method of the audio adapter according to an embodiment of this disclosure.

FIG. 2 is a flowchart of the operation method of the audio adapter 100 according to an embodiment of this disclosure. The flow of FIG. 2 relates to the operation of the audio adapter 100 outputting the audio through the audio jack 101 (i.e., the playback operation). The audio adapter 100 has two main audio sources: the FM audio Si_FM and the host audio Si_hst. As discussed above, the FM audio Si_FM is generated by the FM processing circuit 110 (step S210), and the host audio Si_hst is generated by the processing unit 140 (step S220). The audio codec 120 determines, based on the control signal Ctrl, whether to use the mixer 122 to mix the FM audio Si_FM and the host audio Si_hst (step S230). If the control signal Ctrl instructs the mixer 122 to mix the audio signals (YES branch of step S230), the mixer 122 mixes the FM audio Si_FM and the host audio Si_hst to generate the playback audio So_pbk (step S240). The operation of mixing two or more audios by the mixer 122 is well known to people having ordinary skilled in the art, and the details are thus omitted for brevity. If the control signal Ctrl instructs the mixer 122 not to mix the audios (NO branch of step S230), the mixer 122 uses the FM audio Si_FM or the host audio Si_hst as the playback audio So_pbk (step S250). Then DAC 124 converts the playback audio So_pbk to the analog output audio So_ang and outputs the analog output audio So_ang through the audio jack 101 (step S260). Note that, depending on the content of the analog output audio So_ang, in some cases step S210 or step S220 in the flow of FIG. 2 may be skipped. For example, in cases where only the FM audio Si_FM is played, step S220 can be skipped.

Figure 3:
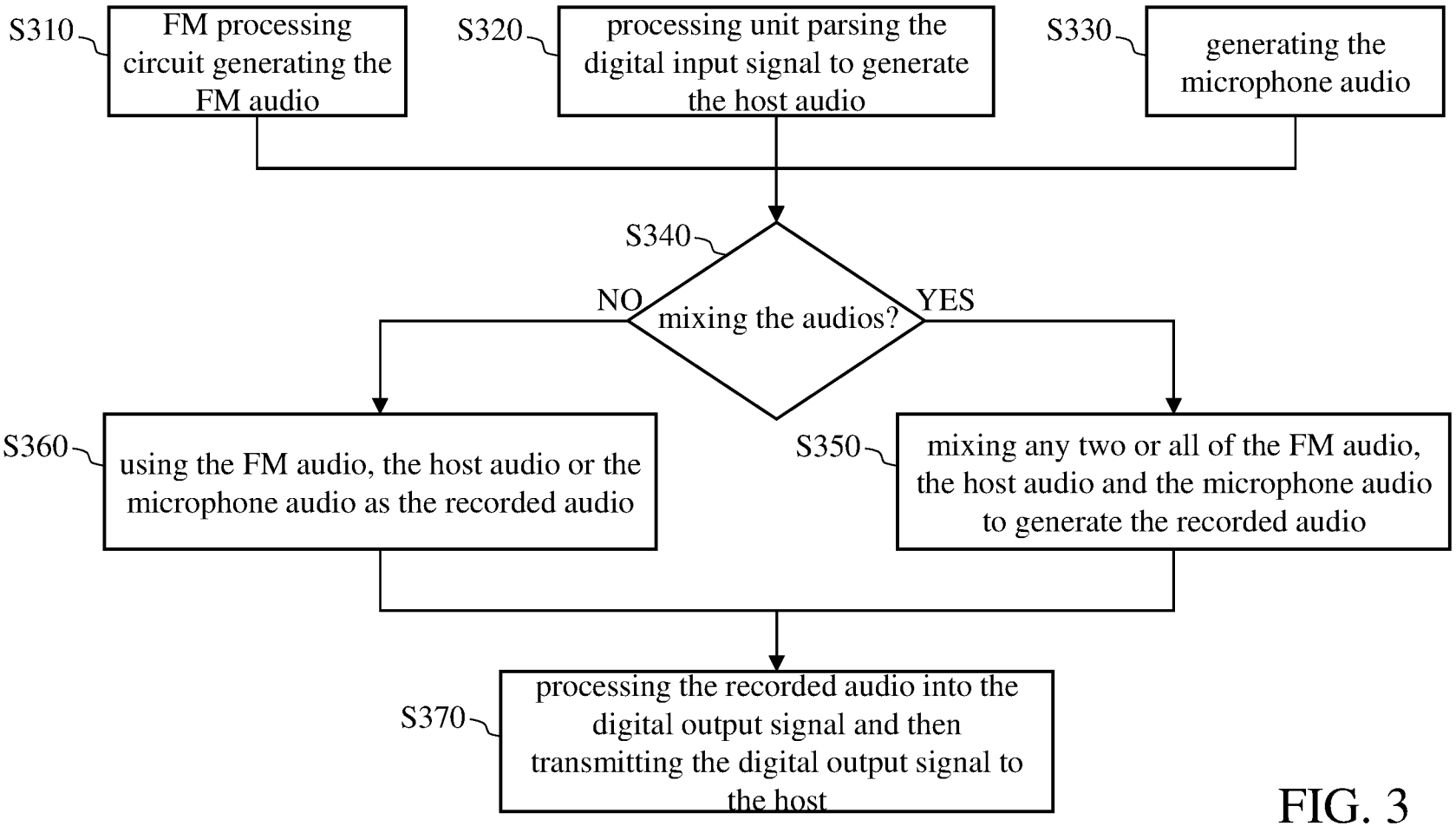
FIG. 3 illustrates a flowchart of the operation method of the audio adapter according to another embodiment of this disclosure.

FIG. 3 is a flowchart of the operation method of the audio adapter 100 according to another embodiment of this disclosure. The flow of FIG. 3 relates to the operation of the audio adapter 100 outputting the signal through the digital interface 102 (i.e., the recording operation). After the FM audio Si_FM, the host audio Si_hst and/or the microphone audio Si_mic are generated, the audio codec 120 determines, in response to the control signal Ctrl, whether to use the mixer 122 to mix any two or all of the FM audio Si_FM, the host audio Si_hst and the microphone audio Si_mic (step S340). Steps S310 and S320 in FIG. 3 are the same as steps S210 and S220 in FIG. 2, respectively, so the details are omitted for brevity. Step S330, performed by the ADC 130, is to convert the analog microphone audio to the digital microphone audio Si_mic. If the control signal Ctrl instructs the mixer 122 to mix the audio signals (YES branch of step S340), the mixer 122 mixes any two or all of the FM audio Si_FM, the host audio Si_hst and the microphone audio Si_mic to generate the recorded audio So_rcd (step S350). If the control signal Ctrl instructs the mixer 122 not to mix the audios (NO branch of step S340), the mixer 122 uses the FM audio Si_FM, the host audio Si_hst or the microphone audio Si_mic as the recorded audio So_rcd (step S360). After the recorded audio So_rcd is generated, the processing unit 140 processes the recorded audio So_rcd into the digital output signal Dout and then transmits the digital output signal Dout to the host for being stored therein (step S370). Note that, depending on the content of the recorded audio So_rcd, in some cases one or two of the steps S310, S320 and S330 in the flow of FIG. 3 may be skipped. For example, in cases where only the FM audio Si_FM is recorded, steps S320 and S330 can be skipped.

Figure 4:
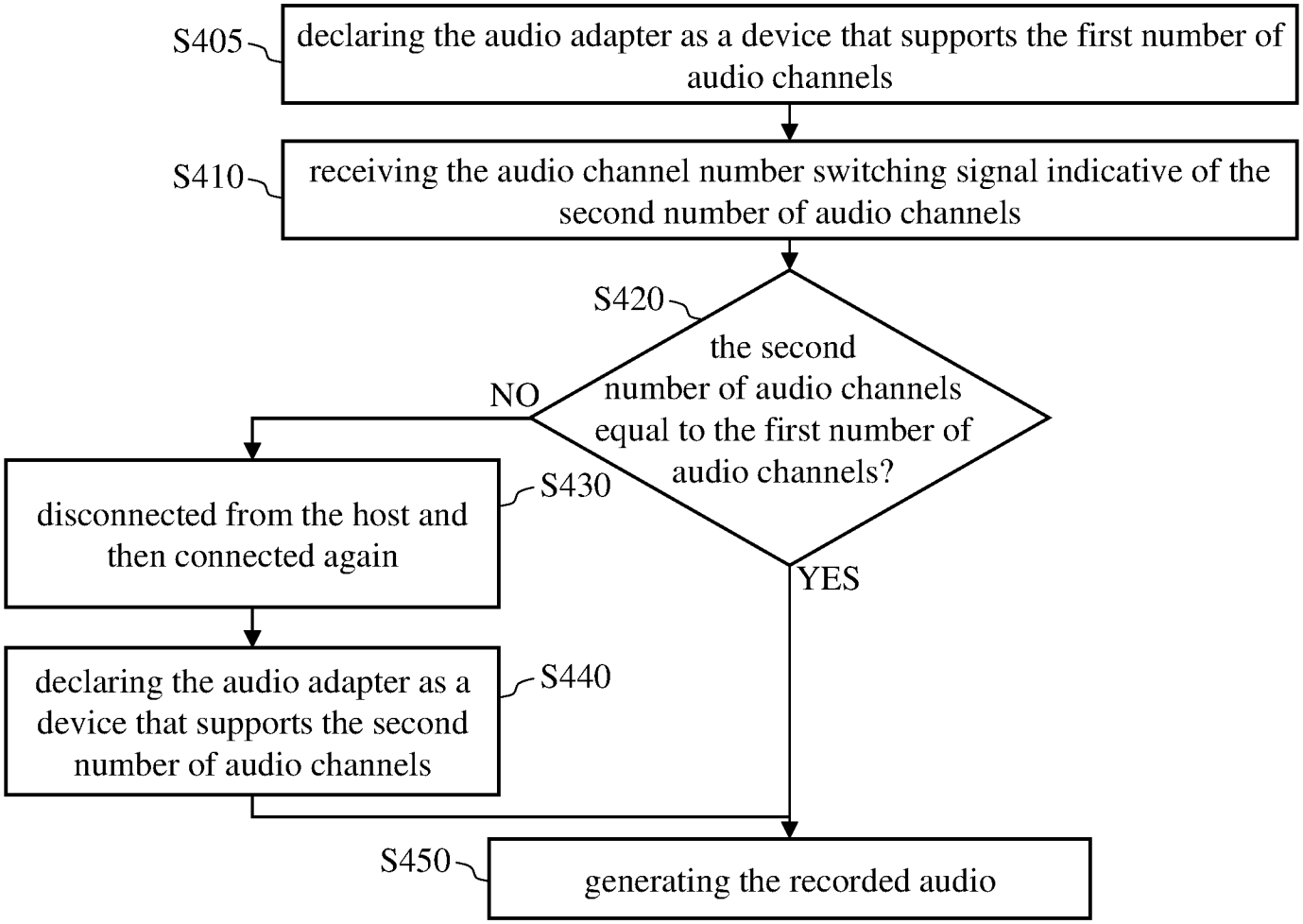
FIG. 4 illustrates a flowchart of switching the number of audio channels of the audio adapter according to an embodiment of this disclosure.

FIG. 4 is a flowchart of switching the number of audio channels of the audio adapter 100 according to an embodiment of this disclosure. In some embodiments, the audio adapter 100 supports multiple audio channels, such as two channels, four channels, eight channels, etc. When the audio adapter 100 is connected to the host, and the host performs device enumeration, the processing unit 140 declares, to the host, the audio adapter 100 as a device that supports the first number of audio channels (step S405). After that, when the user wants to play or record audio with different numbers of audio channels, the user can use the host to send the audio channel number switching signal to the audio adapter 100. After receiving the audio channel number switching signal which instructs the processing unit 140 to switch to the second number of audio channels (step S410), the processing unit 140 determines whether the second number of audio channels is equal to the first number of audio channels (step S420). If not (NO branch of step S420), the processing unit 140 controls the audio adapter 100 to first operate in the disconnected mode and then the connected mode to simulate the audio adapter 100 being unplugged from the host and then plugged into the host again (step S430). More specifically, in step S430, the audio adapter 100 is not physically removed from the host, yet the host operates, as if a device has just been connected thereto, to perform device enumeration again. Next, the processing unit 140 declares the audio adapter 100 as a device that supports the second number of audio channels (step S440) and then controls the audio codec 120 to generate the recorded audio So_rcd based on the second number of audio channels (step S450). If the second number of audio channels is equal to the first number of audio channels (YES branch of step S420), the processing unit 140 controls the audio codec 120 to proceed to generate the recorded audio So_rcd based on the first number of audio channels (step S450). The above-mentioned terminologies (i.e., device enumeration, declaration, disconnected mode and connected mode) are defined in the USB specification and well known to people having ordinary skill in the art, so the details are omitted for brevity.

Figure 5:
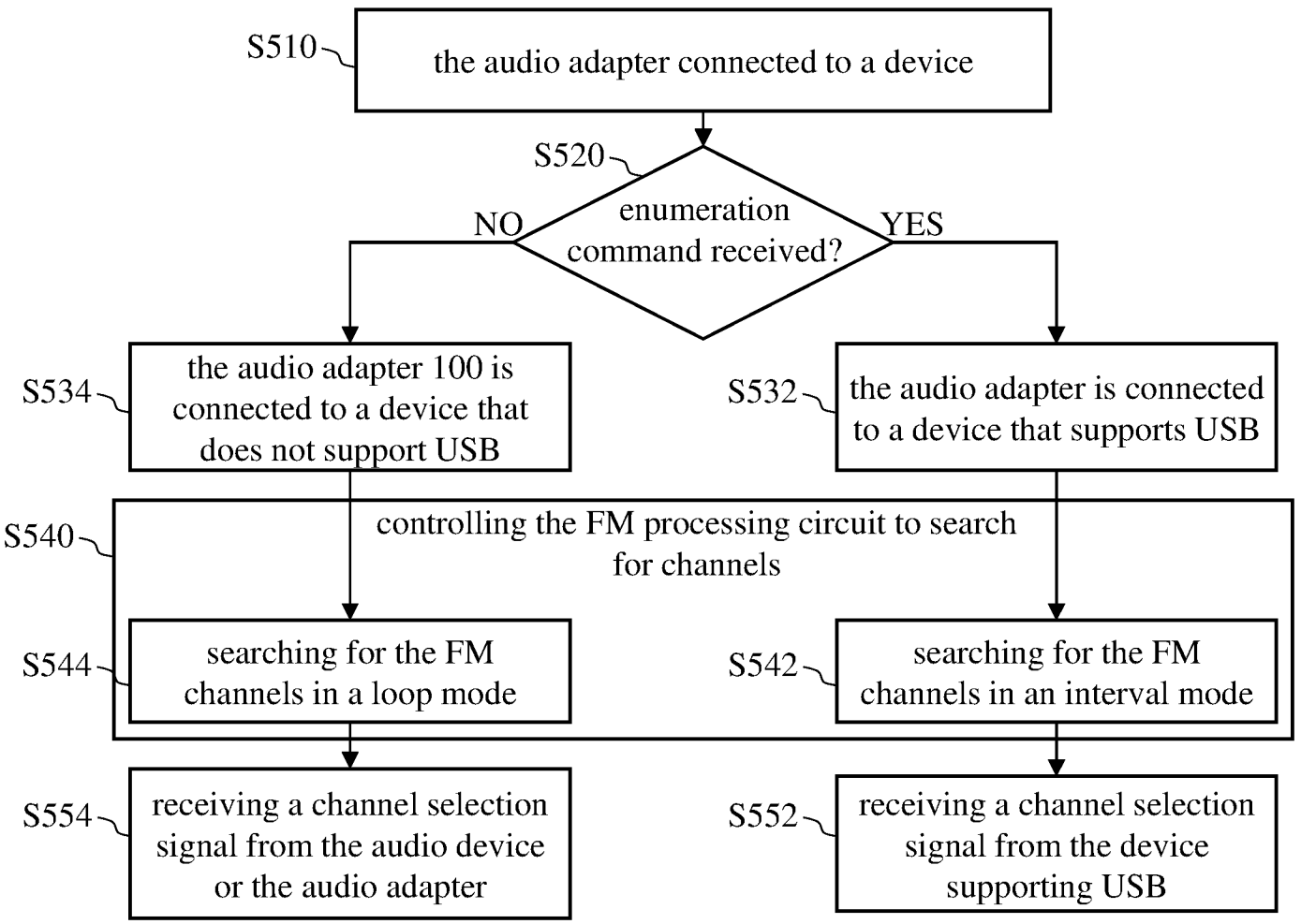
FIG. 5 illustrates a flowchart of the operation method of the audio adapter according to another embodiment of this disclosure.

FIG. 5 is a flowchart of the operation method of the audio adapter 100 according to another embodiment of this disclosure. After the audio adapter 100 is connected to a device (such as a host or a power supply device) through the digital interface 102 (step S510), the processing unit 140 determines whether an enumeration command is received from the device (step S520). If step S520 is positive, the processing unit 140 determines that the audio adapter 100 is connected to a device that supports USB (i.e., a host) (step S532). If step S520 is negative, the processing unit 140 determines that the audio adapter 100 is connected to a device that does not support USB (i.e., a power supply device) (step S534). After step S532 and step S534 finish, the processing unit 140 configures the FM processing circuit 110 and then controls the FM processing circuit 110 to search for channels (step S540). Step S540 includes two search modes: an interval mode and a loop mode. When the audio adapter 100 is connected to a device supporting USB, the processing unit 140 controls the FM processing circuit 110, through the control signal Ctrl, to take the interval mode in the search for the FM channels (step S542) and then receives a channel selection signal from the device supporting USB (step S552). When the audio adapter 100 is connected to a device that does not support USB, the processing unit 140 controls the FM processing circuit 110, through the control signal Ctrl which in this case is generated by the processing unit 140 itself, to take the loop mode in the search for the FM channels (step S544) and then receives a channel selection signal from the audio device coupled to the audio jack 101 or from the audio adapter 100 itself (step S554). In step S554, the channel selection signal may be triggered by a control button on the audio device or on the audio adapter 100 itself.

In the interval mode, the FM processing circuit 110 scans from frequency A to frequency B and then stops the search at frequency B. In other words, the FM processing circuit 110 scans the frequency interval between frequency A and frequency B only once. In the loop mode, the FM processing circuit 110 scans from frequency A to frequency B and then starts from frequency A to scan the frequency again. In other words, the FM processing circuit 110 repeatedly scans the frequency interval between frequency A and frequency B until the FM channel(s) is/are found. In either mode, the FM processing circuit 110 records the frequency at which the signal strength is greater than a threshold value during the search (i.e., scan) process. The recorded frequency or frequencies are the available FM channel(s) to which the user can tune in to listen to.

In some embodiments, a host supporting USB can use the "Format of Setup Data" specified by the USB specification 2.0 to transmit the control commands which are included in the control signal Ctrl. More specifically, the host can generates a variety of control commands by assigning different values to the "wIndex" field and the "wValue" field, with the items "data transfer direction," "type" and "recipient" in the "bmRequestType" field given "host-to-device," "vendor" and "device," respectively, and the "bRequest" field given a custom value other than the "standard request." Table 1 is an implementation example.

TABLE 1

| wIndex | wValue | Meaning of the control command |
|---|---|---|
| 0x001 | 0x000 | the analog output audio So_ang contains only the FM audio Si_FM |
| | 0x001 | the analog output audio So_ang contains only the host audio Si_hst |
| | 0x002 | the analog output audio So_ang is a mixture of the FM audio Si_FM and the host audio Si_hst |
| 0x002 | 0x000 | increase the volume of the FM audio Si_FM |
| | 0x001 | decrease the volume of the FM audio Si_FM |
| 0x003 | 0x000 | mute the FM audio Si_FM |
| | 0x001 | stop muting the FM audio Si_FM |
| 0x004 | 0x000 | search for the previous frequency at which the signal strength is greater than a threshold value |
| | 0x001 | search for the previous frequency at which the signal strength is greater than a threshold value |
| | 0x002 | search in the interval mode (from start to end) |
| | 0x003 | search in the interval mode (from end to start) |
| | 0x004 | search in the loop mode (from start to end) |
| | 0x005 | search in the loop mode (from end to start) |
| 0x005 | Fch | switch to the channel represented by Fch |
| 0x006 | Fch | save the channel represented by Fch in the favorite channels |
| 0x007 | Fch | remove the channel represented by Fch from the favorite channels |
| 0x008 | 0x000 | the recorded audio So_rcd is a 2-channel microphone audio Si_mic |
| | 0x001 | the recorded audio So_rcd is a 2-channel FM audio Si_FM |
| | 0x002 | the recorded audio So_rcd is a 2-channel host audio Si_hst |
| | 0x003 | the recorded audio So_rcd is a 2-channel mixed audio of the FM audio Si_FM and the microphone audio Si_mic |
| | 0x004 | the recorded audio So_rcd is a 2-channel mixed audio of the host audio Si_hst and the microphone audio Si_mic |
| | 0x005 | the recorded audio So_rcd is a 2-channel mixed audio of the host audio Si_hst and the FM audio Si_FM |
| | 0x006 | the recorded audio So_rcd is a 2-channel mixed audio of the FM audio Si_FM, the host audio Si_hst |

TABLE 1-continued

| wIndex | wValue | Meaning of the control command |
|---|---|---|
| | | and the microphone audio Si_mic |
| | 0x007 | the recorded audio So_rcd is a 4-channel audio containing a 2-channel FM audio Si_FM and a 2-channel microphone audio Si_mic |
| | 0x008 | the recorded audio So_rcd is a 4-channel audio containing a 2-channel FM audio Si_FM and a 2-channel mixed audio of the host audio Si_hst and the microphone audio Si_mic |
| | 0x009 | the recorded audio So_rcd is a 4-channel audio containing a 2-channel FM audio Si_FM and a 2-channel mixed audio of the host audio Si_hst, the FM audio Si_FM and the microphone audio Si_mic |
| 0x009 | 0x000 | generating the recorded audio So_rcd with 2 channels |
| | 0x001 | generating the recorded audio So_rcd with 4 channels |

The favorite channels can be stored in the storage circuit 160. "Fch" is the hexadecimal value of the target channel. For example, the "Fch" corresponding to channel 93.7 MHz is 0x249A, which is the hexadecimal value of 9370 in unit of $10^4$ Hz. This disclosure is not limited to 2 channels and 4 channels. People having ordinary skill in the art can generate the control commands for more channels according to the above embodiments.

Furthermore, this disclosure is not limited to USB. People having ordinary skill in the art can apply this disclosure to other types of digital interfaces.

Since a person having ordinary skill in the art can appreciate the implementation detail and the modification thereto of the present method embodiment through the disclosure of the device embodiment, repeated and redundant description is thus omitted. Please note that there is no step sequence limitation for the method embodiments as long as the execution of each step is applicable. Furthermore, the shape, size, and ratio of any element and the step sequence of any flow chart in the disclosed figures are exemplary for understanding, not for limiting the scope of this disclosure.

The aforementioned descriptions represent merely the preferred embodiments of this disclosure, without any intention to limit the scope of this disclosure thereto. Various equivalent changes, alterations, or modifications based on the claims of this disclosure are all consequently viewed as being embraced by the scope of this disclosure.

What is claimed is:

1. An audio adapter with frequency modulation (FM) radio function, comprising:

an audio jack;

an FM processing circuit, coupled to the audio jack and configured to receive an FM signal through the audio jack and to process the FM signal to generate an FM audio;

an audio codec, coupled to the FM processing circuit and the audio jack and configured to receive the FM audio and to output an analog output audio through the audio jack, wherein the analog output audio contains the FM audio;

a digital interface configured to transmit power;

a memory configured to store a plurality of program codes or program instructions; and a processing unit, coupled to the FM processing circuit, the audio codec, the digital interface and the memory and configured to execute the program codes or the program instructions to perform step of:

controlling the FM processing circuit to search for an FM channel.

2. The audio adapter of claim 1, wherein the processing unit receives a digital input signal from a host through the digital interface, parses the digital input signal to generate a host audio, and sends the host audio to the audio codec, and the audio codec mixes the FM audio and the host audio to generate the analog output audio.

3. The audio adapter of claim 1, wherein the audio codec generates a digital output signal, and the processing unit outputs the digital output signal through the digital interface according to a transmission protocol of the digital interface.

4. The audio adapter of claim 3, wherein the digital output signal contains only the FM audio.

5. The audio adapter of claim 3, wherein the audio codec receives a microphone audio through the audio jack, and the digital output signal contains only the microphone audio.

6. The audio adapter of claim 3, wherein the processing unit receives a digital input signal from a host through the digital interface, parses the digital input signal to generate a host audio, and sends the host audio to the audio codec, and the digital output signal contains only the host audio.

7. The audio adapter of claim 3, wherein the audio codec receives a microphone audio through the audio jack and mixes the FM audio and the microphone audio to generate the digital output signal.

8. The audio adapter of claim 3, wherein the audio codec receives a microphone audio through the audio jack, the processing unit receives a digital input signal from a host through the digital interface, parses the digital input signal to generate a host audio, and sends the host audio to the audio codec, and the audio codec mixes the microphone audio and the host audio to generate the digital output signal.

9. The audio adapter of claim 3, wherein the processing unit receives a digital input signal from a host through the digital interface, parses the digital input signal to generate a host audio, and sends the host audio to the audio codec, and the audio codec mixes the FM audio and the host audio to generate the digital output signal.

10. The audio adapter of claim 3, wherein the audio codec receives a microphone audio through the audio jack, the processing unit receives a digital input signal from a host through the digital interface, parses the digital input signal to generate a host audio, and sends the host audio to the audio codec, and the audio codec mixes the FM audio, the microphone audio and the host audio to generate the digital output signal.

11. The audio adapter of claim 1, wherein the audio adapter is connected to a host through the digital interface, and the processing unit declares to the host that the audio adapter supports a first number of audio channels, the processing unit further performing steps of:

controlling the audio adapter to disconnect from the host and connect to the host again when receiving an audio channel number switching signal from the host; and declaring to the host that the audio adapter supports a second number of audio channels;

wherein the first number of audio channels is different from the second number of audio channels.

12. The audio adapter of claim 1, wherein the processing unit further performs steps of:

searching for the FM channel in a first mode when receiving an enumeration command through the digital interface;

searching for the FM channel in a second mode when the enumeration command is not received;

wherein in the first mode a frequency interval is searched once, and in the second mode the frequency interval is searched repeatedly.

* * * * *